US008278811B2

(12) United States Patent
Engel et al.

(10) Patent No.: US 8,278,811 B2
(45) Date of Patent: Oct. 2, 2012

(54) DEVICE AND METHOD FOR CIRCUIT PROTECTION

(75) Inventors: Aaron Engel, Plainville, CT (US); Daniel Edward Delfino, Plainville, CT (US); Dean Arthur Robarge, Plainville, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/981,789

(22) Filed: Dec. 30, 2010

(65) Prior Publication Data

US 2012/0169208 A1 Jul. 5, 2012

(51) Int. Cl.
*H01J 17/26* (2012.01)

(52) U.S. Cl. ..... 313/231.41; 313/231.31

(58) Field of Classification Search ..... 313/234.41, 313/234.31, 231.41, 231.51, 231.61
See application file for complete search history.

(56) References Cited

U.S. PATENT DOCUMENTS 7,821,749 B2 10/2010 Asokan et al.
2009/0101816 A1* 4/2009 Noji et al. ..... 250/310
2009/0197012 A1* 8/2009 Yamazaki et al. ..... 427/534
2009/0203219 A1* 8/2009 Matsuyama et al. ..... 438/719
2009/0250444 A1* 10/2009 Kobayashi et al. ..... 219/121.43
2009/0308845 A1* 12/2009 Bohori et al. ..... 218/157

OTHER PUBLICATIONS

Roscoe et al., Arc-Flash Energy Mitigation by Fast Energy Capture, Industry Applications Society Annual Meeting, 2009. IAS 2009. IEEE, ISSN: 0197-2618, Houston, TX Oct. 4, 2009, pp. 1-9.

* cited by examiner

*Primary Examiner* — Bumsuk Won
(74) *Attorney, Agent, or Firm* — Global Patent Operation; Stephen G. Midgley

(57) ABSTRACT

A device for diverting energy away from an electrical arc flash is provided. The device comprises an arc source configured to create a second arc flash, a plasma gun configured to inject plasma in proximity of the arc source in response to the arc flash, an arc containment device to house the arc source and the plasma gun, an exhaust port configured to route exhaust gases out of the device in a first direction, and an exhaust duct coupled in flow communication with the exhaust port, the exhaust duct comprising a substantially hollow tube including a first tube portion and a second tube portion, the first tube portion coupled in flow communication with the exhaust port, the second tube portion defining an exhaust vent and coupled in flow communication with the first tube portion to route the exhaust gases out of the device in a second direction.

12 Claims, 7 Drawing Sheets

DEVICE AND METHOD FOR CIRCUIT PROTECTION

BACKGROUND OF THE INVENTION

The embodiments described herein relate generally to power equipment protection devices and, more particularly, to apparatus for use in channeling exhaust gases and pressure away from a location of arc generation.

Known electric power circuits and switchgear generally have conductors that are separated by insulation, such as air, or gas or solid dielectrics. However, if the conductors are positioned too closely together, or if a voltage between the conductors exceeds the insulative properties of the insulation between the conductors, an arc can occur. The insulation between the conductors can become ionized, which makes the insulation conductive and enables formation of an arc flash.

An arc flash includes a rapid release of energy due to a fault between two phase conductors, between a phase conductor and a neutral conductor, or between a phase conductor and a ground point. Arc flash temperatures can reach or exceed 20,000° C., which can vaporize the conductors and adjacent equipment. Moreover, an arc flash can release significant energy in the form of heat, intense light, pressure waves, and/or sound waves, sufficient to damage the conductors and adjacent equipment. However, the current level of a fault that generates an arc flash is generally less than the current level of a short circuit, such that a circuit breaker may not trip or exhibits a delayed trip unless the circuit breaker is specifically designed to handle an arc fault condition.

Standard circuit protection devices, such as fuses and circuit breakers, generally do not react quickly enough to mitigate an arc flash. One known circuit protection device that exhibits a sufficiently rapid response is an electrical "crowbar," which utilizes a mechanical and/or electro-mechanical process by intentionally creating an electrical "short circuit" to divert the electrical energy away from the arc flash point. Such an intentional short circuit fault is then cleared by tripping a fuse or a circuit breaker. However, the intentional short circuit fault created using a crowbar may allow significant levels of current to flow through adjacent electrical equipment, thereby still enabling damage to the equipment.

Another known circuit protection device that exhibits a sufficiently rapid response is an arc containment device, which creates a contained arc to divert the electrical energy away from the arc flash point. For example, some known devices generate an arc, such as a secondary arc flash, for use in dissipating energy associated with a primary arc flash detected on a circuit. At least some known arc containment devices include exhaust port that are positioned along a side surface to shorten an exhaust path away from the location where the contained arc is created and into the ambient. However, such venting schemes release hot gases at high pressure into an equipment enclosure, which can cause additional damage to other electronics modules within the same enclosure.

For at least the reasons stated above, a need exists for an arc containment device having an improved exhaust duct apparatus that directs exhaust gasses from an exhaust port on the arc containment device towards an optimized direction into an equipment enclosure.

Additionally, for at least the reasons stated above, a need exists for an arc containment device having an exhaust duct apparatus that is simple, robust, inexpensive, and without moving parts.

BRIEF DESCRIPTION OF THE INVENTION

In one aspect, a device for diverting energy away from an arc flash occurring within an electrical power system is provided. The device includes an arc source configured to create a second arc flash, a plasma gun configured and disposed to inject plasma in proximity of said arc source in response to the arc flash, an arc containment device configured and disposed to house said arc source and said plasma gun, said arc containment device including an exhaust port configured to route exhaust gases out of said arc containment device in a first direction, and an exhaust duct configured to be operatively coupled in flow communication with said exhaust port, the exhaust duct comprising a substantially hollow tube including a first tube portion and a second tube portion, said first tube portion configured to be coupled in flow communication with said exhaust port, said second tube portion defining an exhaust vent and coupled in flow communication with said first tube portion to route the exhaust gases out of said arc containment device in a second direction.

In another aspect a method of manufacturing a device is provided. The method includes disposing an arc source configured to create a second arc flash, disposing a plasma gun configured to inject plasma in proximity of said arc source in response to the arc flash, disposing an arc containment device to house said arc source and said plasma gun, disposing an exhaust port in flow communication with the arc containment device, arranging the exhaust port to route exhaust gases out of the arc containment device in a first direction, and disposing an exhaust duct in flow communication with the exhaust port to route the exhaust gases out of the device in a second direction.

DETAILED DESCRIPTION OF THE INVENTION

Exemplary embodiments of device and methods for use with a circuit protection system are described herein. These embodiments enhance the flow of exhaust gases, heat, and pressure out of the circuit protection system after an arc flash is generated. For example, the circuit protection system can receive a signal that indicates detection of a primary arc flash within a power system coupled to the circuit protection system. The circuit protection system can then generate a secondary arc flash to transfer the energy generated by the primary arc flash away from the power system. Moreover, these embodiments enhance the flow of exhaust gases, heat, and pressure out of a circuit protection device that is part of the circuit protection system. Routing the exhaust gases away from the circuit protection device, such as for example in a substantially vertical direction, protects the circuit protection system and any other electrical equipment that is positioned within an equipment enclosure from the flow of exhaust gases, heat, and pressure.

Figure 1:
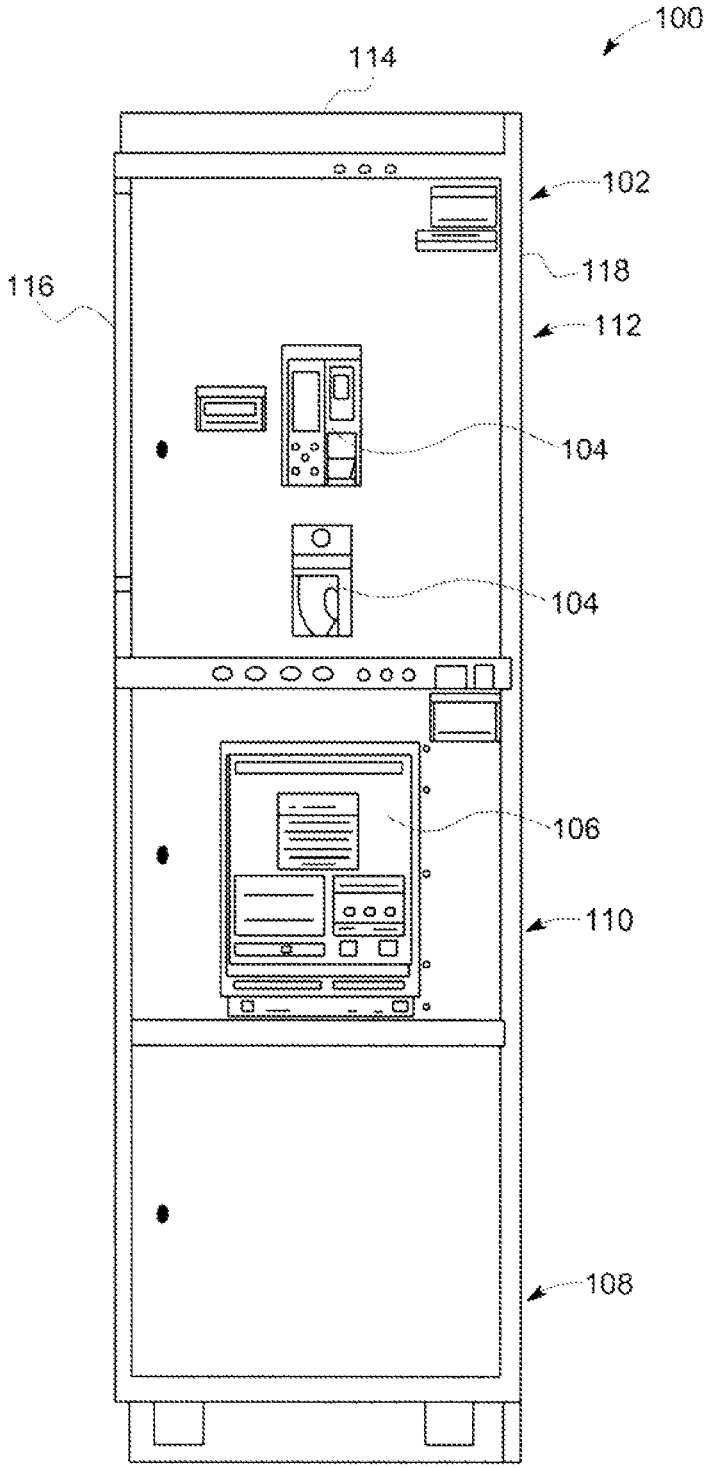
FIG. 1 is a front view of an exemplary electronic equipment stack having a circuit protection system.

FIG. 1 is a front view of an exemplary electronic equipment stack 100 that is housed within an equipment enclosure 102. Stack 100 includes one or more electronics modules 104 and a circuit protection system 106 that provides electronics modules 104 with protection from, for example, arc flash events. Enclosure 102 includes a plurality of compartments, including a lower compartment 108, a center compartment 110 that houses circuit protection system 106, and an upper compartment 112 that houses electronics modules 104. Enclosure 102 has a top wall 114 that extends between a first side wall 116 of enclosure 102 and a second side wall 118. An exhaust opening (not shown in FIG. 1), such as a vent, extends through top wall 114 and is coupled in flow communication to an exhaust plenum (not shown in FIG. 1). The exhaust plenum extends downward from top wall 114 behind electronics modules 102, and into center compartment 110 where the exhaust plenum is positioned with respect to circuit protection system 106. Notably, circuit protection system 106 includes an arc transfer device (not shown in FIG. 1). The arc transfer device transfers energy away from a detected arc flash event in a circuit, such as electronics module 104 or a power feed. The arc transfer device may be an arc containment device, which is described in greater detail below. Alternatively, the arc transfer device may be a bolted fault device that transfers the energy associated with the arc flash event to another location to dissipate in any suitable manner.

Figure 2:
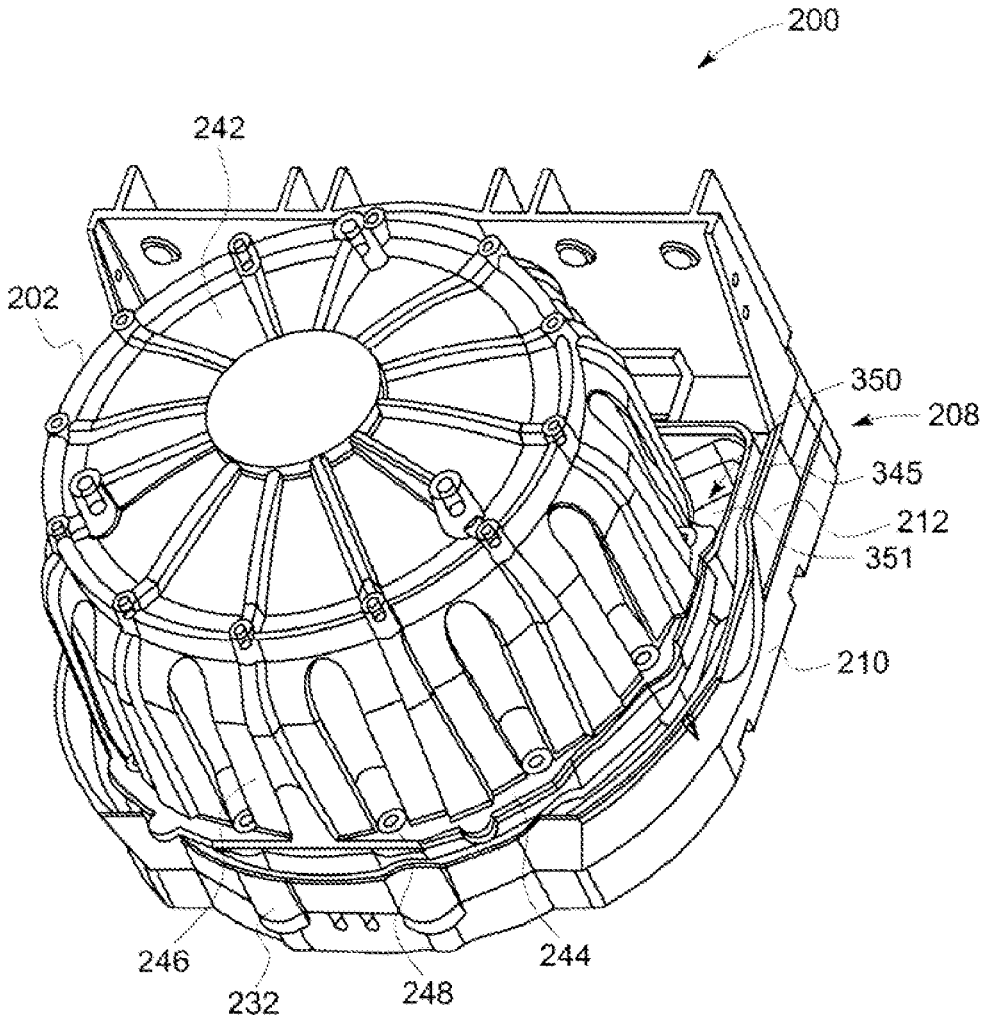
FIG. 2 is a perspective schematic diagram of an exemplary arc containment device that may be used with the circuit protection system shown in FIG. 1.
Figure 3:
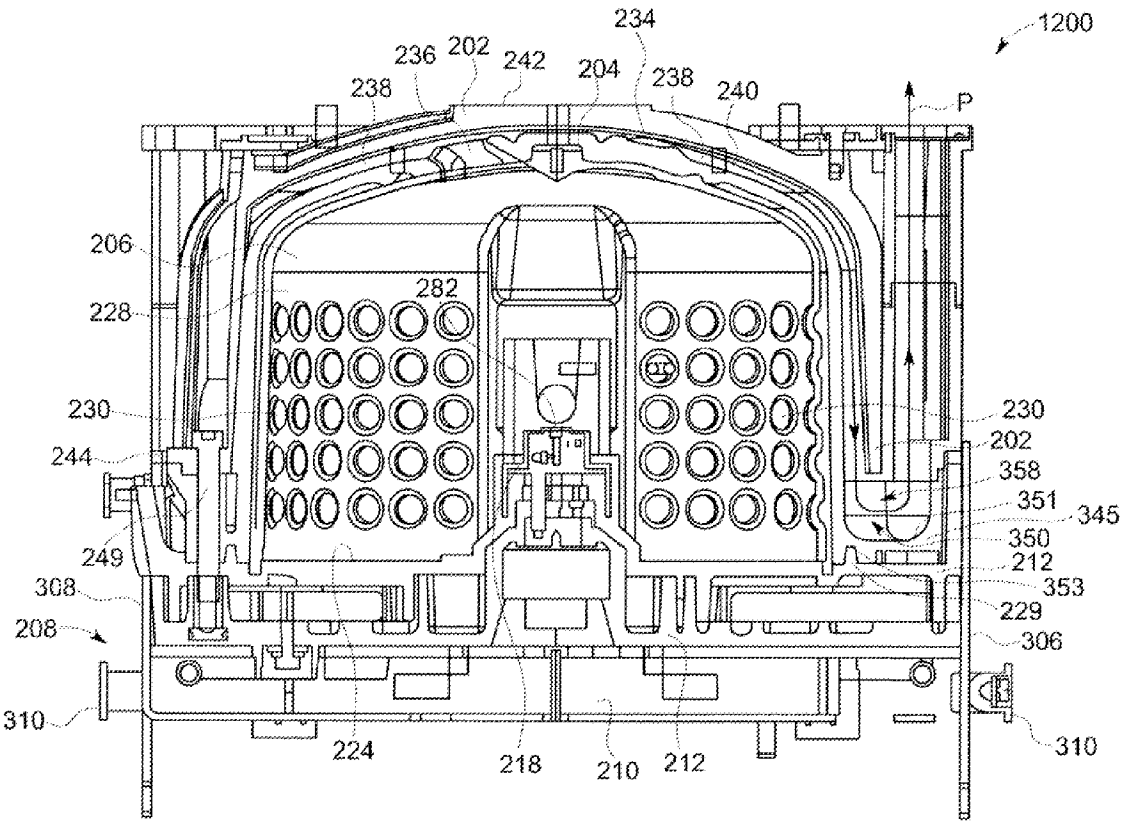
FIG. 3 is a cross-section schematic diagram of the arc containment device shown in FIG. 2.
Figure 4:
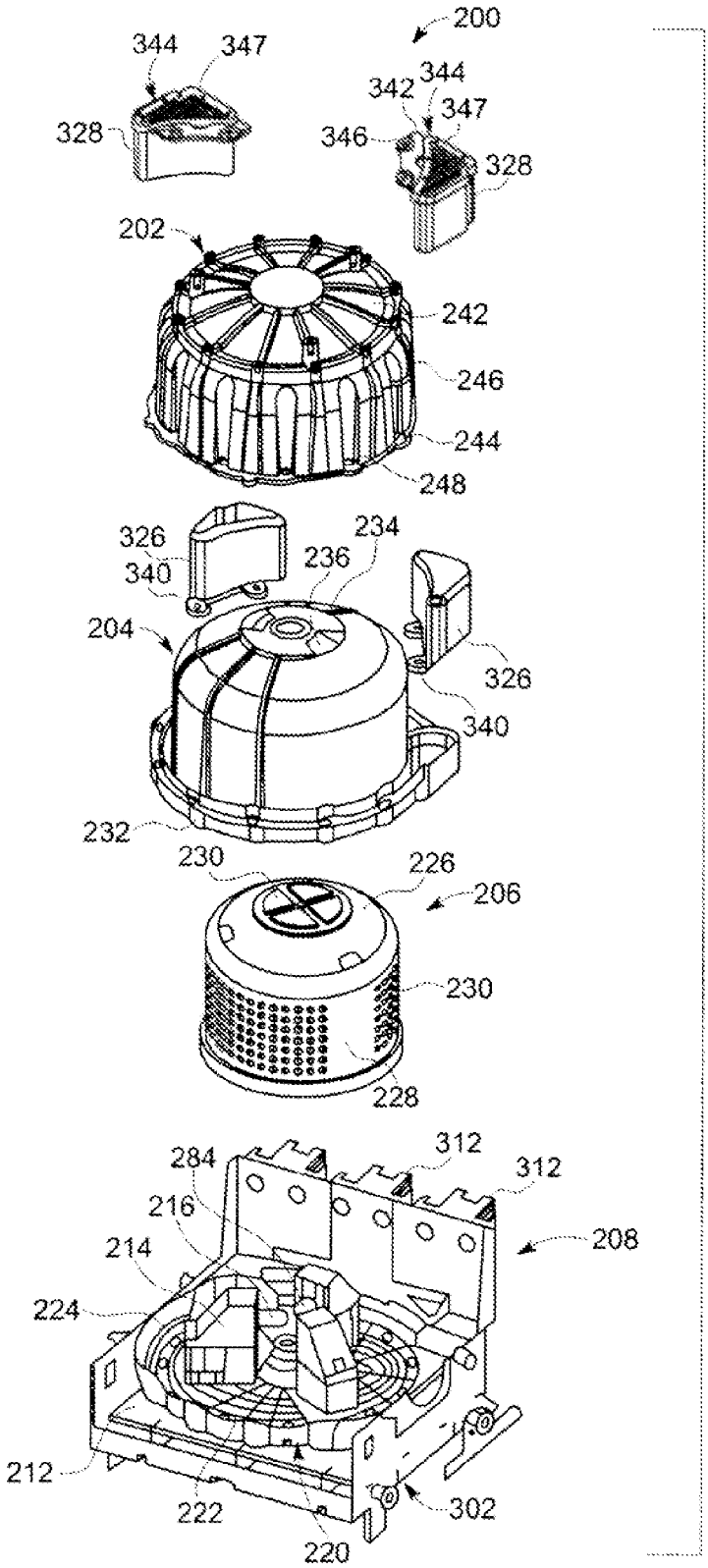
FIG. 4 is a partially exploded diagram of the arc containment device shown in FIG. 2.

FIG. 2 is a perspective schematic diagram of an exemplary arc containment device 200 that may be used with the circuit protection system 106 of FIG. 1; FIG. 3 is a cross-section schematic diagram of arc containment device 200; and FIG. 4 is a partially exploded diagram of arc containment device 200. In an exemplary embodiment, arc containment device 200 includes a top cover 202 (FIGS. 2-6), an exhaust manifold 204 (FIGS. 3 and 4), a shock shield 206 (shown in FIGS. 3 and 4), and a conductor assembly 208 (FIG. 4). As shown in FIGS. 2, 3, 5 and 6, conductor assembly 208 includes a conductor base 210 and a conductor cover 212 with a plurality of electrical conductors (not shown) positioned therebetween. Each electrical conductor is coupled to an electrode support 214 that supports an arc source electrode 216 (FIG. 4). Each arc source electrode 216 is rigidly mounted onto the conductor cover 212 and spaced apart to define an arc source electrode gap 284. Each electrical conductor (not shown) extends through conductor base 210 to connect the electrodes 216 to a power source (not shown), such as a power bus. The conductor base 210 and a conductor cover 212 may be made of any suitable electrically insulating material and composites to provide an electrically insulative support for the electrodes 216.

An arc triggering device such as a plasma gun 282 is disposed proximate the arc source electrode gap 284, for example centrally disposed with respect to the arc source electrodes 216, and configured to ionize a portion of the space in the arc source electrode gap 284. In one embodiment, the plasma gun 282 injects plasma as an arc mitigation technique, to create a secondary arcing fault in response a signal indicative of a primary arc flash within the power system coupled to the circuit protection system 106. In an embodiment, the plasma gun 282 is covered by a plasma gun cover 218 (FIG. 3). In operation, the arc source electrodes 216 generate an arc, such as a second arc flash, for use in dissipating energy associated with a primary arc flash detected on a circuit, thus producing exhaust gases, heat, and pressure within arc containment device 200.

Conductor cover 212 includes a plurality of mounting apertures (not shown) that are each sized to receive a respective fastening mechanism therein to couple conductor cover 212 to a support such as a conductor base 210. Moreover, conductor cover 212 includes an edge portion 220 having a plurality of recesses 222 formed therein (FIG. 4). As will be discussed in more detail below, conductor cover 212 includes one or more mating features, such as a rib 229, configured to mate with a corresponding mating feature, such as a slot 353 formed in an exhaust port member 345 of exhaust manifold 204.

Top cover 202 includes a top surface 242, a lip 244, and a side surface 246 extending between top surface 242 and lip 244. Lip 244 is sized to overlay exhaust manifold posts 232 (FIGS. 2 and 4), and includes a plurality of mounting apertures 248 that are sized to receive a respective fastening mechanism, such as a threaded bolt 249 therein to couple to conductor cover 212. For example, each mounting aperture 248 of top cover 202 aligns with a respective mounting aperture of exhaust manifold 204 and a respective mounting aperture 222 of conductor cover 212.

Moreover, as shown in FIGS. 3 and 4, shock shield 206 is sized to cover electrodes 216 and is disposed over the electrodes 216 such that the arc source is contained within the shield 206. In an embodiment shock shield 206 is fixedly coupled to a top surface 224 of conductor cover 212.

In an exemplary embodiment, shock shield 206 includes a top surface 226 and a side surface 228. A plurality of exhaust vents 230 are formed in top and side surfaces 226 and 228. Exhaust manifold 204 is sized to cover shock shield 206. Exhaust manifold 204 includes a plurality of posts 232 (FIG. 4). Each post 232 includes a mounting aperture (not shown) sized to receive a respective fastening mechanism therein to couple exhaust manifold 204 to conductor cover 212. Moreover, each post 232 is sized to fit within a respective recess 222 of conductor cover 212.

In an exemplary embodiment, and as shown in FIG. 3, top cover 202 is sized to cover exhaust manifold 204 such that the manifold 204 is contained with cover 202 and to define a cavity 238 therebetween for use as a passageway or exhaust path 240, generally indicated in FIG. 3 by arrow "P". In an exemplary embodiment, exhaust manifold 204 also includes a top surface 234 with a plurality of exhaust vents 236 extending therethrough and in flow communication with exhaust path 240. Likewise, the plurality of exhaust vents 236 are in flow communication with the plurality of exhaust vents 230 of shock shield 206. Additionally, exhaust manifold 204 includes at least one exhaust port member 345. Exhaust port member 345 includes a first exhaust port surface 351 configured to cooperate with a portion of top cover 202 to define an opening or gap 358. Gap 358 is disposed in flow communication with the exhaust path 240 and arranged to provide an exhaust port 350 for the venting of exhaust gases, heat, and pressure from cavity 238 and out of arc containment device 200. In an exemplary embodiment, exhaust manifold 204 includes two exhaust port members 345 formed on the exterior of exhaust manifold 204. In operation, the one or more mating features, such as a slot 353 disposed on exhaust port member 345, cooperates with the corresponding mating features, such as a rib 229, disposed on conductor cover 212 to provide structural rigidity, and prevent undesired "blow-by" of exhaust gases, heat, and pressure from within exhaust manifold 204 to an electrical ground, such as the frame 302, and thereby prevent an undesired ground strike.

Figure 5:
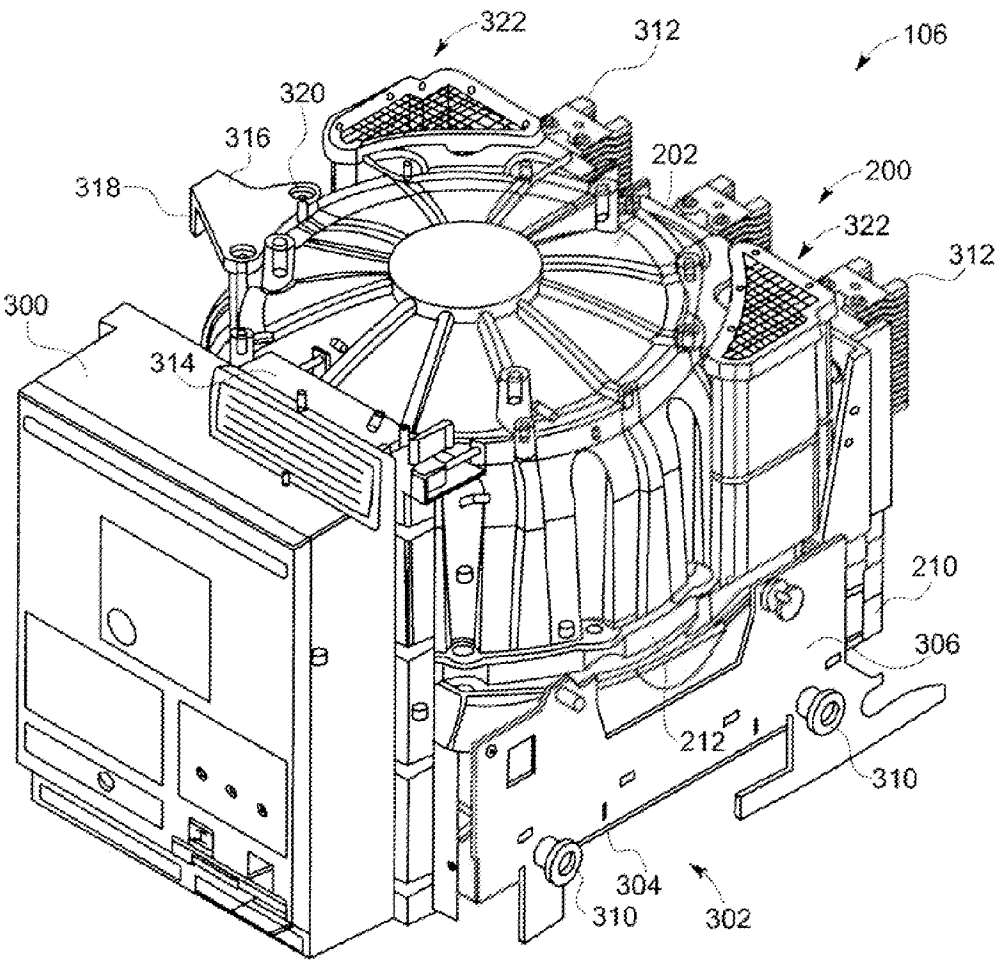
FIG. 5 is a perspective schematic diagram of the circuit protection system of FIG. 1.
Figure 6:
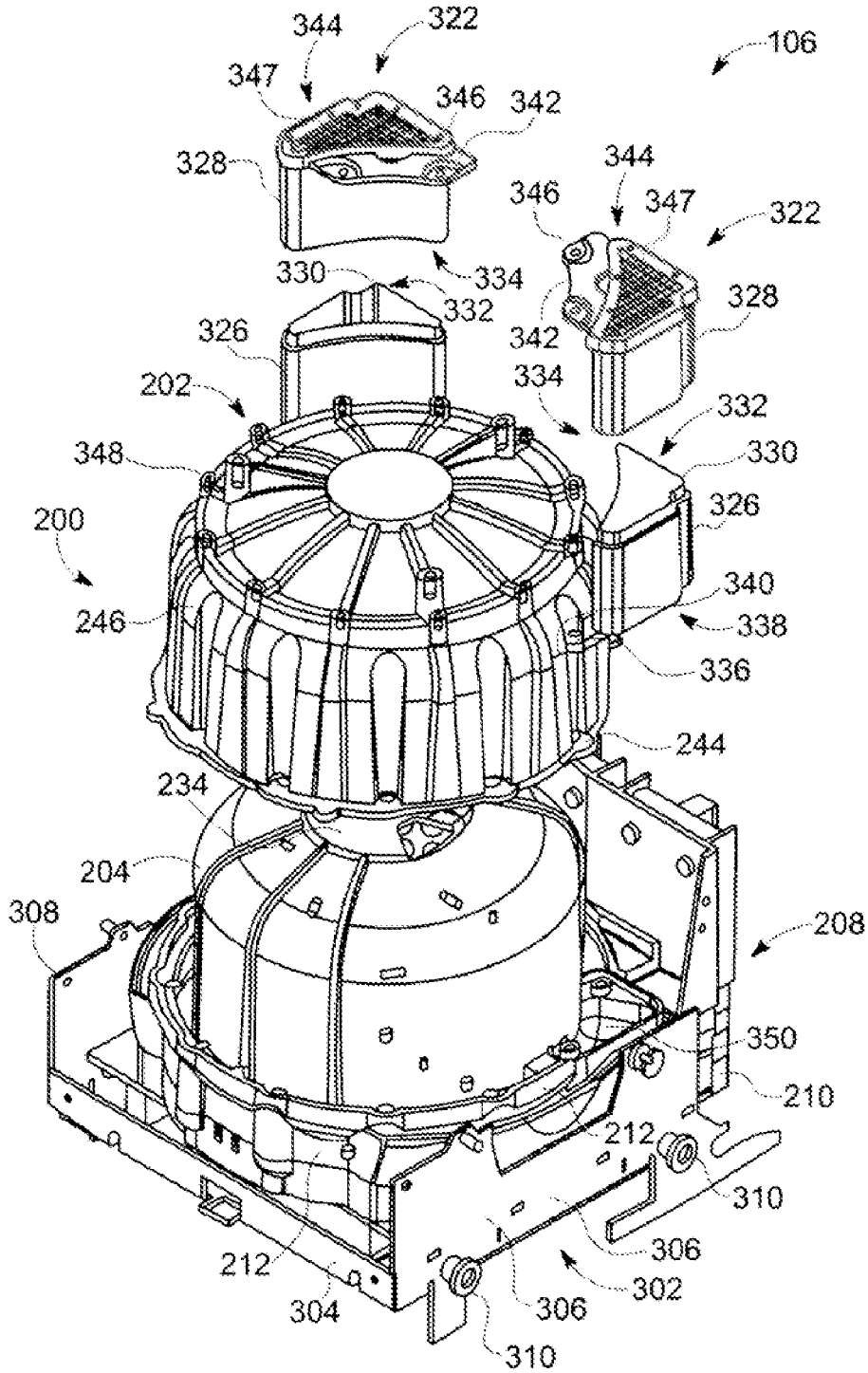
FIG. 6 is a partially exploded view of the circuit protection system of FIG. 1.

Furthermore, arc containment device 200 includes one or more non-conductive exhaust ducts 322 positioned on the periphery of top cover 202. In an exemplary embodiment, as illustrated in FIGS. 4-6, arc containment device 200 includes two exhaust ducts 322. Each exhaust duct 322 directs exhaust gases from exhaust ports 350

FIG. 5 is a perspective schematic diagram of circuit protection system 106, and FIG. 6 is a partially exploded view of circuit protection system 106. In an exemplary embodiment, circuit protection system 106 includes a controller 300 and arc containment device 200. The frame 302 is sized to support arc containment device 200 within equipment enclosure 102 (FIG. 1). Preferably, frame 302 is electrically coupled to ground. Controller 300 is coupled to frame 302 to secure controller 300 to arc containment device 200 when inserting or removing circuit protection system 106 from equipment enclosure 102. In an exemplary embodiment, frame 302 includes a bottom wall 304, a first sidewall 306, and a second side wall 308. Side walls 306 and 308 each include one or more rollers 310 that are sized to be inserted into or used with racking rails (not shown) provided within an enclosure compartment, such as center compartment 110 (FIG. 1).

During operation, controller 300 receives a signal from, for example, electronics modules 104 (FIG. 1), indicating detection of a primary arc flash on a circuit that is monitored by one or more monitoring devices (not shown), such as a current sensor, a voltage sensor, and the like. In response to the detection, controller 300 causes a plasma gun 282 to emit a plume of an ablative plasma. Specifically, the plasma gun 282 emits the plasma into the gap 284 defined between electrodes 216 (FIG. 4). The plasma lowers an impedance between the tips of electrodes 216 to enable formation of a secondary arc flash. The secondary arc flash releases energy including heat, pressure, light, and/or sound.

Figure 6A:
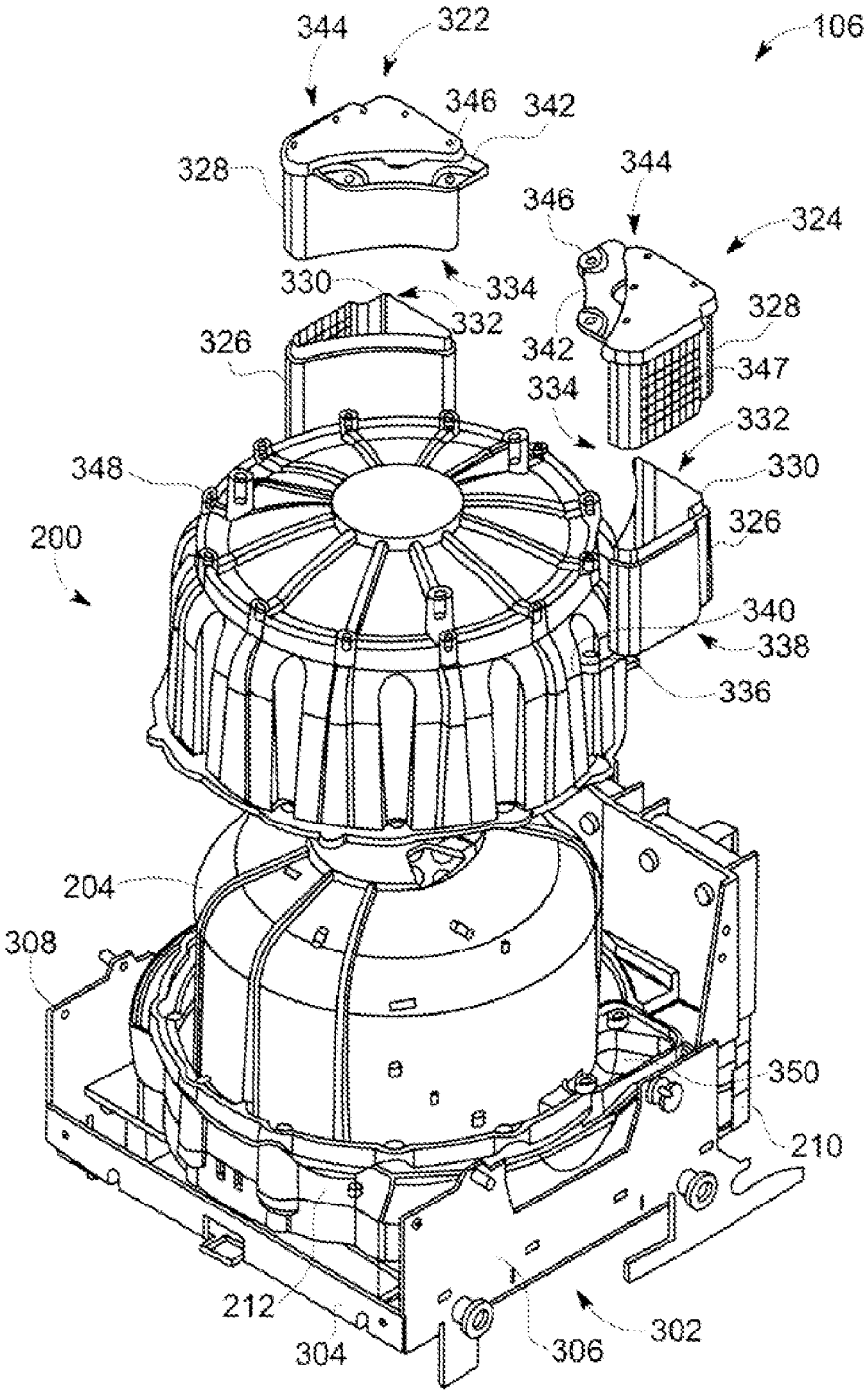
FIG. 6*a* is a partially exploded view of an alternative embodiment circuit protection system of FIG. 1.

The secondary arc flash also creates exhaust gases. The exhaust gases are channeled through exhaust vents 230 of shock shield 206. The exhaust gases are also channeled through exhaust vents 236 (FIG. 4) of exhaust manifold 204, and into exhaust path 240 (FIG. 2) defined between exhaust manifold 204 and top cover 202. The exhaust gases flow along exhaust path 240 and are channeled in a first direction through exhaust ports 350 and then channeled in a second direction through exhaust duct 322, and out of arc containment device 200 such as into an exhaust plenum (not shown in FIGS. 5 and 6) within equipment enclosure 102. For example, in an embodiment as illustrated in FIG. 6, the second direction may be in the same direction as the first direction. In another embodiment as indicated in FIG. 6*a*, the second direction may be at an angle to the first direction. For example in an embodiment, the second direction may be substantially horizontal when the first direction is substantially vertical. In another embodiment, the second direction may substantially horizontal when the first direction is substantially vertical.

While each exhaust duct 322 is shown in the Figures, by way of example and not limitation, as having a generally triangular cross-section, it is contemplated that each exhaust duct 322 may comprise a pipe, tube, or channel having any generally convenient cross-section. Each exhaust duct 322 may be oriented and arranged to direct the exhaust gases in any desired predetermined direction. Likewise, while the embodiments in the Figures, by way of example and not limitation, illustrate two exhaust ports 350, it will be understood that any number of exhaust ports may be formed as described, and arranged in flow communication with the exhaust path 240. Likewise, while the embodiments in the Figures, by way of example and not limitation, illustrate two exhaust ducts 322 connected in flow communication with corresponding exhaust ports 350, it will be understood that any number of exhaust ducts 322 may be provided in an embodiment. In an embodiment, as shown in FIG. 6, each exhaust duct 322 includes a lower or first exhaust duct portion 326 and an upper or second exhaust duct portion 328 that is coupled to lower exhaust duct portion 326. For example, lower exhaust duct portion 326 includes a lip 330 that extends at least partially along a periphery of a top end 332. Lip 330 is sized to be inserted into a bottom end 334 of upper exhaust duct portion 328. Lower exhaust duct portion 326 includes a flange 336 along at least a portion of a bottom end 338. Flange 336 includes a plurality of mounting apertures 340 that are sized to receive a respective fastening mechanism therein to couple to top cover 202. For example, each mounting aperture 340 of lower exhaust duct portion 326 aligns with a respective mounting aperture 248 of top cover 202 and a respective mounting aperture of exhaust manifold 204. Similarly, upper exhaust duct portion 328 includes a flange 342 along at least a portion of a top end 344. Flange 342 includes a plurality of mounting apertures 346 that are sized to receive a respective fastening mechanism therein to couple to top cover 202. For example, each mounting aperture 346 of upper exhaust duct portion 328 aligns with a respective mounting aperture 348 of top cover 202. Preferably, as shown in FIGS. 4-6, the distal end of upper exhaust duct portion 328 is configured with a protective mesh or screen 347 to prevent undesired entry of objects into the exhaust duct 322.

While the embodiments in the Figures, by way of example and not limitation, illustrate each exhaust duct 322 being formed of two separate components, it will be understood, that in an embodiment, each exhaust duct 322 may be unitary, or as any desired number of components coupled together.

A plurality of first primary electrical connectors 312 are coupled to arc containment device 200 to electrically connect arc containment device 200 to a plurality of conductors (not shown) of a circuit (not shown) that is being monitored and/or protected by arc containment device 200. Moreover, controller 300 (FIG. 5) includes a first secondary electrical connector 314 that connects controller 300 to a second secondary connector (not shown) for use in performing diagnostics and/or plasma gun firing tests. A position indicator 316 is coupled to top cover 202 and is oriented to engage a switch (not shown) that is provided in a racking cassette (not shown) to indicate a position of arc containment device 200 within the racking cassette as described in greater detail below. For example, position indicator 316 includes a flange 318 having one or more mounting apertures 320 extending therethrough and sized to receive a respective fastening mechanism to couple position indicator 316 to top cover 202. Accordingly, top cover 202 includes one or more corresponding mounting apertures (not shown) that are positioned beneath respective mounting apertures 320 of flange 318. Notably, position indicator 316 may be coupled to any suitable portion of arc containment device 200 that enables the switch to indicate the position of arc containment device 200 within the racking cassette.

Exemplary embodiments of apparatus for use in devices for protection of power distribution equipment are described above in detail. The systems, methods, and apparatus are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

Although the present invention is described in connection with an exemplary circuit protection environment, embodiments of the invention are operational with numerous other general purpose or special purpose circuit protection environments or configurations. The circuit protection environment is not intended to suggest any limitation as to the scope of use or functionality of any aspect of the invention. Moreover, the circuit protection environment should not be interpreted as having any dependency or requirement relating to any one or combination of components illustrated in the exemplary operating environment.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

When introducing elements of aspects of the invention or embodiments thereof, the articles "a," "an," "the," and "said" are intended to mean that there are one or more of the elements. The terms "comprising," including," and "having" are intended to be inclusive and mean that there may be additional elements other than the listed elements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A device for diverting energy away from an arc flash occurring within an electrical power system, the device comprising:

an insulative base, said insulative base comprising a first mating feature;

an arc source configured to create a second arc flash;

a plasma gun configured and disposed to inject plasma in proximity of said arc source in response to the arc flash;

an arc containment device configured and disposed to house said arc source and said plasma gun, said arc containment device including an exhaust port comprising a second mating feature and configured to route exhaust gases out of said arc containment device in a first direction; and an exhaust duct configured to be operatively coupled in flow communication with said exhaust port, said exhaust duct comprising a substantially hollow tube including a first tube portion and a second tube portion;

said first tube portion configured to be coupled in flow communication with said exhaust port;

said second tube portion defining an exhaust vent and coupled in flow communication with said first tube portion to route the exhaust gases out of said arc containment device in a second direction;

wherein said first mating feature and said second mating feature are disposed to cooperate to operatively prevent an undesired blow-by of exhaust.

2. The device of claim 1, wherein said second direction is a substantially vertical direction.

3. The device of claim 1, wherein said second direction is a substantially horizontal direction.

4. The device of claim 1, wherein said second direction is at an angle to said first direction.

5. The device of claim 1, wherein said first tube portion includes a first end and a second end, said first and second ends being coupled in flow communication;

said second tube portion includes a third end and a fourth end, said third and fourth ends being coupled in flow communication;

wherein said first end is further configured to be coupled in flow communication with the exhaust port; and said second end is configured to be in flow communication with said third end.

6. The exhaust duct of claim 1, wherein said first portion and said second portion are formed as a single unit.

7. The device of claim 1 wherein said first mating feature is one of a slot or a rib, and said second mating feature is the other of a slot or a rib.

8. A method of manufacturing a device for diverting energy away from an arc flash occurring within an electrical power system, the method comprising:

disposing an arc source configured to create a second arc flash;

disposing a plasma gun configured to inject plasma in proximity of said arc source in response to the arc flash;

disposing an arc containment device including an insulative base having a first mating feature to house said arc source and said plasma gun;

disposing an exhaust port having a second mating feature in flow communication with the arc containment device, disposing said first mating feature and said second mating feature to cooperate to operatively prevent an undesired blow-by of exhaust;

arranging the exhaust port to route exhaust gases out of the arc containment device in a first direction; and disposing an exhaust duct in flow communication with the exhaust port to route the exhaust gases out of the device in a second direction.

9. The method of claim 8, wherein the second direction is a substantially vertical direction.

10. The method of claim 8, wherein the second direction is a substantially horizontal direction.

11. The method of claim 8, wherein said second direction is at an angle to said first direction.

12. The method of claim 8, wherein said exhaust duct is formed as a single unit.

* * * * *